United States Patent [19]

Forestier

[11] Patent Number: 4,875,663

[45] Date of Patent: Oct. 24, 1989

[54] CLOSURE DEVICE WITH CLEANING OF A POURING HOLE

[75] Inventor: Guy Forestier, Saint-Rambert, France

[73] Assignee: Clecim, Courbevoie, France

[21] Appl. No.: 205,886

[22] Filed: Jun. 13, 1988

[30] Foreign Application Priority Data

Jun. 11, 1987 [FR] France ..... 87 08157

[51] Int. Cl.[4] ..... F27B 03/08

[52] U.S. Cl. ..... 266/272; 266/287

[58] Field of Search ..... 266/271, 272, 269, 287, 266/45

[56] References Cited

U.S. PATENT DOCUMENTS

| | | | |
|---|---|---|---|
| 2,643,203 | 6/1953 | Drackley | 266/271 |
| 3,438,619 | 4/1969 | Forster | 266/287 |
| 4,202,536 | 5/1980 | Demidowicz et al. | 266/271 |

FOREIGN PATENT DOCUMENTS

| | | | |
|---|---|---|---|
| 2467651 | 4/1981 | France . | |
| 2555719 | 5/1985 | France | 266/269 |
| 61-26719 | 6/1986 | Japan . | |
| 1085208 | 9/1967 | United Kingdom . | |

*Primary Examiner*—S. Kastler

*Attorney, Agent, or Firm*—Pollock, VandeSande & Priddy

[57] ABSTRACT

Closure device for a pouring hole (2) having a vertical axis, arranged in the base (11) of a container (1) containing molten metal. The device comprises a flap (3) fixed to the end of a maneuvering arm (3) which is horizontally displaceable to a level below that of the base (11), between a stand-by position and a closure position, and a device for controlling the vertical displacement at least of the end of the arm (31) in order to apply the closure flap (3) on a seating (22) on the periphery of the discharge orifice of the pouring hole (2). The maneuvering arm (31) has a cleaning member (5) located beside the closure flap (3) and centered on the trajectory of the latter. The arm (31) may be stopped in two positions of alignment, with the flap (3) and with the cleaning member (5), respectively, in the axis of the pouring hole (2), and in a position of alignment with the cleaning member, at a level which is adjustable with respect to the seating (22) of the flap (3) in order to remove metal residue adhering to the edge of the discharge orifice.

10 Claims, 3 Drawing Sheets

CLOSURE DEVICE WITH CLEANING OF A POURING HOLE

FIELD OF THE INVENTION

The invention relates to a closure device with cleaning of a pouring hole arranged, along a vertical axis, in the base of a container containing molten metal, and in particular to the pouring of liquid steel from an electric smelting furnace into a transfer ladle placed beneath the pouring hole.

BACKGROUND OF THE INVENTION

In steel production, electric furnaces are presently used for the smelting of scrap iron. Such a furnace comprises a vessel in which electrodes penetrate and the base of which forms a hearth covered with refractory material and forming a basin in which the liquid steel obtained by smelting of the scrap iron accumulates. This steel must be discharged periodically into a transfer ladle by means of a horizontal spout which is an integral part of the hearth of the furnace and the base of which is equipped with a pouring orifice, having a substantially vertical axis, beneath which is placed the transfer ladle for the liquid steel. Generally, steel is poured out of the furnace by tilting the vessel.

The pouring orifice must be equipped with a removable closure device generally comprising a plate, which may be protected by a refractory material, forming a flap mounted so as to slide or tilt so that it may be applied on a seating arranged on the periphery of the discharge orifice of the pouring hole. Normally, the closure flap is covered, before the arrival of the liquid metal, with a protective powder filling the pouring hole.

The normal procedure for pouring is therefore as follows:

After smelting the scrap iron and filling the vessel, the steel covers the pouring hole or is drawn into the spout, e.g., by tilting the vessel. The pouring hole is then opened by sliding or tilting the closure flap and, after discharge by means of gravity of the protective powder contained in the pouring hole, pouring of the steel takes place.

When the desired mass of steel has run into the ladle, the container is caused to tilt in the opposite direction to discharge the liquid steel from the area located above the pouring hole, so as to stop the pouring. At this moment, the pouring hole ought to be closed by means of the flap. However, during pouring, a residue consisting of a solidified skin of steel having a cylindrical shape has formed on the periphery of the orifice, extending the pouring hole over a certain height. This residue prevents the flap being applied against its seating in a leakproof manner and must therefore be removed before closure of the flap. For this reason, when the container is tilted to discharge the steel from the area located above the pouring hole, it is necessary to manually clean the lower surface of the pouring hole in order to ensure correct application of the flap. The latter is then maneuvered so as to close the pouring hole and protective powder is then placed above the flap in the pouring hole, the container can then return to its normal working position, the pouring hole once again being covered with liquid metal for moving onto a new pouring.

Manual cleaning of the lower surface of the pouring hole is a difficult operation in a dangerous and inaccessible area and requires means of access such as a retractable platform in order to reach the pouring hole. For cleaning, use is made of a heavy and cumbersome tool which is difficult to handle and inaccurate, and this results in the risk of a false maneuver which can cause incorrect cleaning and local damage, with the risks of perforation and leakage of liquid steel during the smelting operation if the flap is badly applied on its seating.

SUMMARY OF THE INVENTION

The invention allows these drawbacks to be remedied by virtue of a device which makes it possible to ensure a very leakproof closure of the pouring hole by associating the closure flap with remotecontrolled means permitting the completely safe removal of the solidified residues before the application of the closure flap on its seating.

The invention therefore relates to a closure device of the type comprising a closure flap fixed at the end of a maneuvering arm, a means for controlling the displacement of the flap along a trajectory passing through the axis of the pouring hole by means of horizontal displacement of the maneuvering arm to a level below that of the base of the container, between a stand-by position and a closure position, and a means for controlling the displacement of the end of the arm transversely to the base in order to apply the closure flap on a seating arranged on the periphery of the discharge orifice of the pouring hole.

According to the invention, the maneuvering arm has a cleaning member located beside the closure flap and centered on the trajectory of the latter. The means for controlling the horizontal displacement of the arm determines the stoppage of the latter in two positions of alignment, with the flap and with the cleaning member, respectively, in the axis of the pouring hole, and the means for controlling the vertical displacement of the arm determines the positioning of the cleaning member, in a position of alignment with the cleaning member, at a level which can be adjusted with respect to the seating of the flap in order to remove metal residues adhering to the edge of the discharge orifice.

In a preferred embodiment, the maneuvering arm is mounted so as to rotate about an axis parallel to that of the pouring hole, and comprises two branches extending radially from the axis of rotation over the same length and carrying at their free ends the closure flap and the cleaning member, respectively, and the means for controlling the vertical displacement of the flap determines the positioning of the arm on three levels, namely, a lower maneuvering level of the arm, an upper level for applying the flap on its seating, and an adjustable intermediate level for removing the residues.

The invention also covers the use of a cleaning device operating independently of the closure device proper and comprising therefore a cleaning member located at the end of a support arm which is capable of moving, parallel to the base between a distant stand-by position and a working position on the one hand, and transversely to the base, on the other hand, so as to progressively approach the discharge orifice of the pouring hole in order to remove the residues deposited on the periphery of the latter.

The invention allows the use of various types of cleaning members.

In a first embodiment, the cleaning member consists of a metal brush driven in rotation about an axis parallel to that of the pouring hole.

In another embodiment, the cleaning member comprises a spindle extending beyond the end of the maneuvering arm along an axis parallel to that of the pouring hole and driven in rotation about its axis, a plurality of bars, forming hammers, each being fixed to the spindle by means of an articulated connection so as to hang along the spindle in a rest position and to move away radially, by means of a centrifugal effect, when the spindle rotates. Preferably, the hammers have lengths which decrease as they become more remote from the base connecting the spindle to the arm.

The rotary drive of the cleaning member about its axis may be controlled by a motor fixed directly to the end of the manoeuvring arm or alternatively, distant from the latter and connected to the cleaning member by a transmission system mounted along the arm.

The cleaning member may also consist of tongs comprising at least two jaws for gripping the solid residues which extend in the extension of the pouring hole. The jaws are advantageously mounted so as to hinge on the end of the maneuvering arm, each one about an axis orthogonal to the axis of the pouring hole, and interact with a mandrel mounted so as to slide along a central axis parallel to that of the pouring hole and comprising a conical point which can penetrate into the pouring hole by removing the solid residue and, on the opposite side, a part forming a cam which, by means of axial displacement of the mandrel, can control the opening and the closure of the jaws by resting on a lever which is solid with each jaw.

However, the cleaning member may also consist of a nozzle mounted so as to project at the end of the arm and equipped ~~with~~ at least one injection orifice fed at least with combustive gas and possibly with fuel gas by means of at least one pipe fixed along the arm.

BRIEF DESCRIPTION OF THE DRAWINGS

The invention will be better understood from the following description thereof with reference to the appended drawings.

DESCRIPTION OF PREFERRED EMBODIMENT

Figure 1:
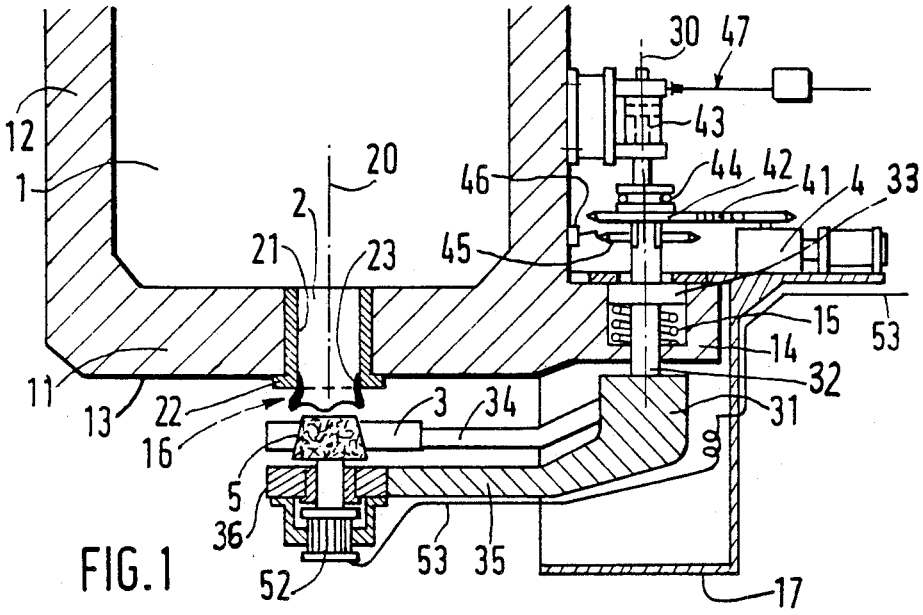
FIG. 1 represents diagrammatically the overall device in section along a plane passing through the axis of the pouring hole and the axis of rotation of the maneuvering arm.

FIG. 1 shows diagrammatically a container 1 intended to contain liquid steel and which may be, for example, the spout of an electric furnace. The container is therefore limited by a base 11 and lateral walls 12 covered with a refractory cladding. A cylindrical orifice 2, centered on a vertical axis 20, is arranged in the base 11 of the container 1 and forms the pouring hole. The latter is limited by a refractory cladding 21, the periphery of which, on the lower surface 13 of the base 11, forms a seating 22 on which a closure flap 3 is applied, which flap consists of a plate made of refractory material placed on the free end of a maneuvering arm 31 mounted so as to rotate about an axis 30 parallel to the axis 20 of the pouring hole and placed outside the container 1 along the lateral face 12 of the latter.

The rotation of the manoeuvring arm 31 is controlled, for example, by a geared motor assembly 4 by means of a transmission chain 41 which engages with a pinion 42 wedged in rotation on a shaft 32 controlling the rotation of the arm 31.

The maneuvering arm 31 may also be displaced in translation by means of a jack 43 centered on the axis of rotation 30 and the rod of which is connected to the rotation shaft 32 by means of an axial stop 44 one part of which is fixed on the rod of the jack 43 and the other on the rotation shaft 32, the latter being mounted so as to slide on a support 14 which is solid with the base 11 of the container. In order to allow the shaft 32 to slide with respect to the drive pinion 42, the latter may be equipped, in a known manner, with an internal toothing which engages on a splining arranged along the shaft 32.

The jack 43 may be a double-action jack but, for safety reasons, it is preferred to use a single action jack to control the descent of the arm against the action of a spring 15, which is slipped onto the shaft 32 and rests, on one side, in the base of a housing arranged in the support 14 and, on the other side, on a shoulder 33 of the shaft 32, and which can be applied on a stop for limiting the vertical travel of the arm corresponding to the application of the flap 3 on its seating 22 under sufficient pressure.

Other arrangements may also be used for controlling the application of the flap on its seating. The manoeuvring arm may, for example, tilt about a horizontal axis under the action of a jack, the direction of which would be determined as a function of the layout possibilities, it being possible for the jack to be connected to the arm by means of a lever system.

Figure 2:
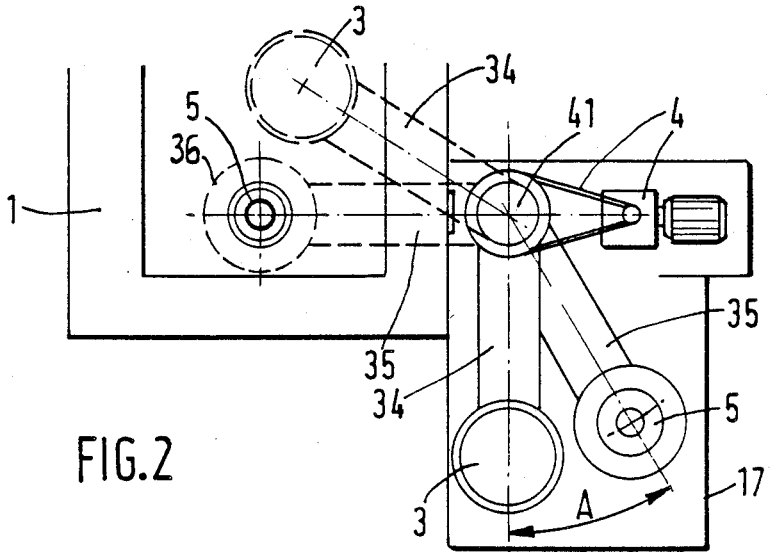
FIG. 2 is a plan view of the maneuvering arm carrying the closure flap and the cleaning member, in a stand-by position and in a cleaning position.

As has been shown on FIG. 2, such arrangements make it possible to displace the arm, in a low position, between a stand-by position in which the flap 3 is distant from the pouring hole and a working position in which the flap 3 is placed in alignment with the pouring hole, the axis of the arm 31 then being in the vertical plane P passing through the axis 20 of the pouring hole and the axis of rotation 30.

However, according to one of the features of the invention, the maneuvering arm 31 comprises two branches, a first branch 34 carrying the closure flap 3 and a second branch 35 carrying at its free end a cleaning member 5, respectively.

The two branches 34 and 35 of the arm 31 together form an angle A and have the same length, the closure flap 3 and the cleaning member 5 being centered on axes equidistant from the axis 30 of rotation.

In this manner, it is possible, by means of the motor 4, to control the rotation of the arm 31 and to stop the latter in two different angular positions for centering the arm 34 or the arm 35, respectively, in the plane P. It is thus possible to displace both the closure flap 3 and the cleaning member 5 in alignment with the pouring hole.

The angular position of the maneuvering arm 31 may be controlled, possibly remotely, by an angle detector comprising, for example, a graduated disc 45 which is solid in rotation with the shaft 32 and interacts with a sensor 46 connected to a display system.

As shown in the drawings, there forms, during pouring, at the outlet of the pouring hole, a deposit of solidified metal 16 consisting of an irregular skin with a substantially cylindrical shape, located in the extension of the inner surface 21 of the pouring hole and extending beyond the discharge surface 22 over a certain height.

In the example represented in FIG. 1, the cleaning member 5 is a metal brush mounted so as to rotate about an axis 51 on the free end 36 of the arm 35. The rotation of the brush about its axis 51 is controlled by a motor 52 which may be mounted directly on the end 36 of the arm 35. The motor 52 may, for example, be an electric motor fed by a circuit 53 which extends along the branch 35 of the arm 31.

As indicated above, the jack 43, fed by a hydraulic circuit 47, makes it possible to adjust the height of the arm 31 between two levels, high and low, respectively. The level of the low position is determined taking into account the height of the cleaning member 5 and of the anticipated length of the residue 16 so that the arm 31 may rotate freely. As shown in FIG. 1, the branch 34 carrying the closure flap 3 may be located at a higher level than the branch 35 for supporting the cleaning member 5, which is more cumbersome.

After pouring the steel and when the container 1 has been caused to tilt in order to drain the base 11 at the pouring hole 2, the arm 31 is caused to rotate to bring the cleaning member 5 into alignment with the pouring hole 2.

The brush 5 preferably has a frusto-conical form, its diameter at its upper part being less than the diameter of the pouring hole 2 and increasing towards the base up to a diameter which is greater than that of the hole 2. In this manner, ~~if the~~ pressure in the jack 43 is progressively released, the arm assembly 31 rises again under the action of the spring 15 and the brush 5 penetrates into the irregularly shaped sleeve formed by the residue 16. The arm 31 is then stopped in this intermediate position, the jacks 43 making it possible to adjust the pressure applied on the residue by the brush 5 driven in rotation by the motor 52. The residue 16 is then destroyed and removed and the brush 5 is partially slid into the outlet end of the pouring hole 2 so as to perfectly clean the edge 23 of the orifice and the seating 22.

The jacks 43 then return the arm 31 to a low position and the arm is caused to rotate so as to place the flap 3 in alignment with the hole 2 and, by releasing the pressure in the jack 43, the flap 3 is applied on the seating 22 of the pouring hole under a pressure regulated by the spring 15.

The cleaning member 5 may be embodied in various ways.

Figure 3:
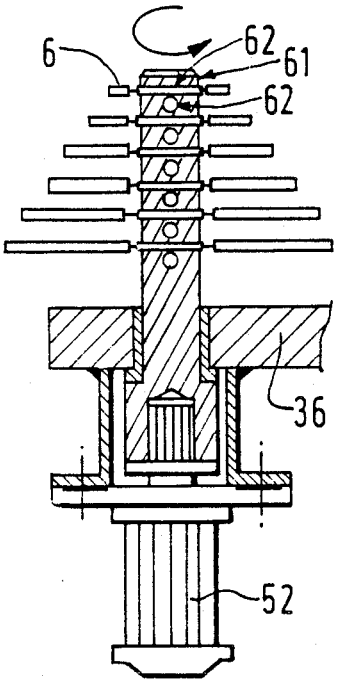
FIG. 3 is a detail view, on a larger scale, of a hammer cleaning member.
Figure 4:
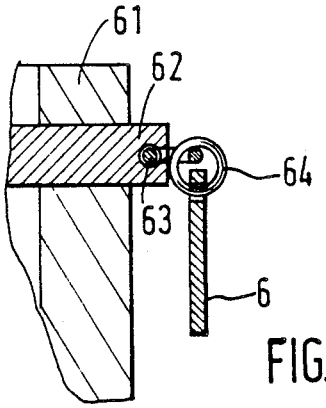
FIG. 4 is a detail view of the mounting of a hammer.

In FIGS. 3 and 4, for example, the cleaning member consists of an assembly of hammers 6 mounted on a spindle 61 extending beyond the end 36 of the branch 35 of the maneuvering arm along an axis parallel to the axis of rotation 30 and to the axis 20 of the pouring hole. Each hammer 6 consists of a metal bar which, as shown in detail in FIG. 4, is hinged on the spindle 61 about an axis perpendicular to the axis 60 of the latter. For example, the spindle 61 is pierced by a pin 62 at the end of which is fixed a ring 63 on which engages a ring 64 fixed to the end of the hammer 6. By virtue of this simple but solid mounting, the hammer 6 hangs, in a rest position, alongside the spindle 61 when the latter is stationary, and extends horizontally by centrifugal force, in the position represented in FIG. 3 when the spindle 61 is driven in rotation by a motor 52 fixed on the end of the arm 36 on the side opposite the spindle, as described above with respect to brush 5.

The pins 62 carrying the various hammers are distributed along the entire height of the spindle 61 and are offset angularly, and the bars forming the hammers 6 have lengths which increase from the top to the bottom of the spindle such that, when the latter is driven in rotation, the assembly takes on a frusto-conical shape, the hammers 6 covering a circle the radius of which is less than that of pouring hole 2 at the top of the spindle and greater than this radius at the bottom part of the spindle.

In this manner, by controlling the progressive introduction of the hammers 6 into the residue 16 by means of the jack 43, the destruction and removal of said residue is determined.

Figure 5:
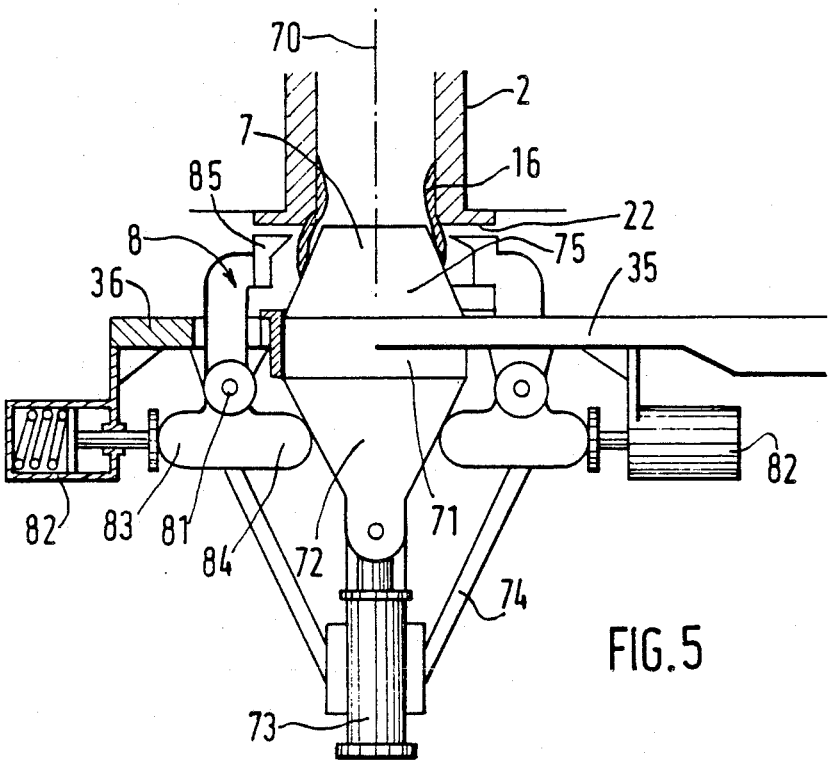
FIG. 5 is a detail view, in axial section, of a tong cleaning member.

If it is preferred to avoid the use of a rotary cleaning member which may wear away the refractory cladding 21 of the pouring hole 2, it is also possible to use a tong member such as that represented in FIG. 5.

In this case, the cleaning member comprises a mandrel 7 associated with a plurality of jaws 8. The mandrel 7 comprises a cylindrical part 71 mounted so as to slide in a guide orifice having the same diameter and arranged on the end 36 of the arm 35 and fixed at its lower part 72 on the rod of a jack 73 which is itself fixed by legs 74 on the underside of the end 36 of the arm 35. The jack 73 is fed by pipes (not shown) which extend along the arm 35 below the latter and can therefore control the upward or downward axial displacement of the mandrel 7. The latter is equipped at its upper part with a frusto-conical portion 75 the upper end of which has a smaller diameter than that of the pouring hole 2 and which widens progressively so as to be able to insert itself in the sleeve 16 forming the residue, under the action of the jack 73, by removing the solidified skin. The latter may then be cut away and gripped by jaws 8 which are mounted so as to rotate on the end 36 of the arm 35 about shafts 81 orthogonal to the axis 70 of the mandrel.

When the cleaning member is placed in position and the part 75 of the mandrel 7 is inserted in the residue, the jaws 8 are held open by triggers 82 which rest on levers 83 located at the end of the jaws 8. The levers 83 rest at their other end 84 on the lower part 72 of the mandrel 7 which forms a cam having a conical shape and which widens towards the top. In this manner, when the withdrawal of the mandrel 7 is controlled under the action of the jack 73, the displacement of the conical cam 72 determines the space between the ends 84 of the levers 83 and, consequently, the gripping of the jaws 8 which carry at their free end knives 85 which can cut away the residue 16 by resting on the point 75 of the mandrel 7. The knives 85 may also cause the simple loosening of the residue 16 which is then pulled from the seating 21 of the pouring hole when the arm 35 is caused to return to a low position under the action of the jack 43.

Figure 6:
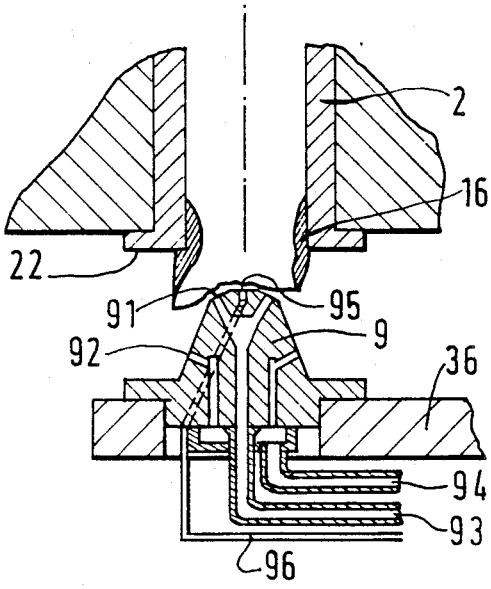
FIG. 6 is a detail view, in axial section, of a torch-effect cleaning member.

It is also possible to remove the residue 16 by smelting and combustion, by means of the arrangement represented in FIG. 6.

In this case, the cleaning member consists of a nozzle 9 extending in upward projection on the end 36 of the arm 35 and acting in the manner of a torch head. To this end, it is possible to provide, for example, two levels of injectors, 91, 92 respectively, connected separately to pipes 93, 94 for supplying oxygen or a mixture of oxygen and fuel gas. A pilot injector 95, fed by a pipe 96, may also be placed at the upper end and in the axis of the head 9.

After pouring, the branch 35 of the maneuvering arm 31 places the nozzle 9 in the axis of the pouring hole in the manner described above for the other types of cleaning members. The pilot injector 95 is then in service. If the residue 16 is hot enough, as is evident from its color, the upper injectors 91 are fed with pure oxygen to cause rapid combustion thereof. If the residue 16 is already cold, the upper injectors 91 are then fed with a mixture of gas and oxygen in order to cause prior heating, and then oxygen alone is injected.

As indicated above, it is possible progressively to raise the nozzle 9 and to bring into service the lateral injectors 92 alone or in parallel with upper injectors 91 so as to complete removal of the residue 16.

It can be seen that the invention makes it possible to achieve the cleaning of the pouring hole by various means, but that this operation is always carried out in conditions which are comfortable and safe for the operator, who does not have to approach the base of the container, all the operations being performed automatically by the device which can itself be well-protected by a housing 17.

If the invention is specially adapted to closure devices employing a flap mounted on the end of the rotating arm which can be displaced axially by translation, the same arrangements could very well be adapted to other closure systems operating, for example, by means of tilting the arm supporting the flap, or, alternatively, by sliding as in slide nozzles, the cleaning device then being independent of the flap.

I claim:

1. Device for cleaning and closing a pouring hole (2) having a vertical axis (20), said pouring hole being provided in a base (11) of a container (1) containing molten metal, said pouring hole being delimited by a refractory cladding (21) a periphery of which forms a seating (22) on a lower surface (13) of said base (11) of said container (1), said molten metal forming, after pouring, a solidified residue extending on a periphery of said seating (22), said cleaning and closing device comprising (a) a maneuvering arm (31) mounted for rotation about an axis (30) parallel to said vertical axis (2) of said pouring hole and comprising first and second branches (34, 35) extending radially from said axis of rotation (30) and having the same length;

(b) a closure flap (3) mounted at a free end of said first branch (34) of said maneuvering arm and a cleaning member (5) mounted at a free end of said second branch (35) of said maneuvering arm;

(c) means (4) for rotating said maneuvering arm (31) about its vertical axis for controlling horizontal displacement of said closure flap (3) and of said cleaning member (5) from a stand-by position along a trajectory passing through said axis (20) of said pouring hole (2) to a lower maneuvering level below that of said base (11) and for stopping said maneuvering arm in two different angular positions, respectively a cleaning position in which said cleaning members are centered on said axis of said pouring hole (2) and a closing position in which said closure flap (3) is centered on said axis of said pouring hole (2); and (d) lowering means (43) and raising means (15) for controlling vertical displacement of said maneuvering arm (31) and for determining positioning of said arm (31) at a lower maneuvering level, an adjustable intermediate cleaning level, and an upper closing level, respectively;

(e) said rotating means (4) and said means for controlling vertical displacement (43, 15) of said maneuvering arm (31) being associated for determining successively:

(i) rotation of said maneuvering arm (31) at said lower level and stoppage of said arm in said cleaning position;

(ii) raising of said cleaning member at said adjustable intermediate level for removing said residue and cleaning said seating;

(iii) returning of said arm (31) to said lower level and the rotation and stoppage of said arm (31) in said closing position; and (iv) raising of said closure flap to said upper level to apply it to said seating (22).

2. Cleaning device according to claim 1, wherein an upper part of said cleaning member (5) has a diameter smaller than a diameter of said pouring hole, said diameter of said cleaning member increasing toward a base of said cleaning member to a diameter which is greater than that of said pouring hole.

3. Cleaning device according to claim 1, wherein said cleaning member consists of a metal brush (5) associated with means (52) for controlling rotation of said brush about an axis parallel to said axis of said pouring hole.

4. Cleaning device according to claim 1, wherein said cleaning member comprises a spindle (61) extending beyond said free end (36) of said second branch (35) of said maneuvering arm (31) along an axis (60) parallel to said axis of said pouring hole, said spindle being associated with means (52) for controlling rapid rotation of said spindle (61) about its axis, a plurality of bars (6) forming hammers, each of said hammers being fixed to said spindle (61) by means of an articulated connection (62, 63) so as to hang alongside said spindle (61) in a rest position and to move away radially by centrifugal force when said spindle (61) rotates.

5. Cleaning device according to claim 4, wherein said hammers (6) have lengths which decrease as they become more remote from the base connecting said spindle (61) to said second branch (35) of said maneuvering arm (31).

6. Cleaning device according to claim 3 or 4, wherein said cleaning member is driven in rotation by a motor (52) fixed directly to said free end (36) of said second branch (35) of said maneuvering arm (31).

7. Cleaning device according to claim 1, wherein said cleaning member consists of a part comprising at least two jaws (8) for gripping said solid residue (16).

8. Cleaning device according to claim 7, wherein said jaws (8) are mounted so as to hinge on an end of said maneuvering arm, each of said jaws being hinged about an axis (81) orthogonal to said axis (20) of said pouring hole, and interacting with a mandrel (7) mounted for sliding movement along a central axis (70) parallel to said axis of said pouring hole and comprising a frustoconical portion (75) which can penetrate into the pouring hole (2) upon removal of said solid residue (16).

9. Cleaning device according to claim 8, wherein said mandrel (7) comprises a part forming a cam (72) which, by means of axial displacement, controls opening and closure of said jaws (8) by resting on a lever (84) which is solid with each said jaw (8).

10. Cleaning device according to claim 1, wherein said cleaning member consists of a nozzle means (9) mounted so as to project at an end (36) of said second branch (35) of said maneuvering arm (31), said nozzle means comprising at least one injection orifice (91) connected to a circuit (93) for feeding combustive gas into said nozzle.

* * * * *